US006108847A

United States Patent [19]

Cueman et al.

[11] Patent Number: 6,108,847

[45] Date of Patent: Aug. 29, 2000

[54] ANTIMICROBIAL BRUSH

[75] Inventors: Glenn F. Cueman, Davidson; William D. Hanrahan, Charlotte, both of N.C.

[73] Assignee: Microban Products Company, Huntersville, N.C.

[21] Appl. No.: 09/309,029

[22] Filed: May 10, 1999

Related U.S. Application Data

[63] Continuation-in-part of application No. 08/855,019, May 12, 1997, abandoned.

[51] Int. Cl.[7] ..... A46B 15/00

[52] U.S. Cl. ..... 15/104.94; 15/167.1; 15/207.2; 424/405; 424/409; 523/122

[58] Field of Search ..... 424/405, 409; 523/122; 300/21; 15/167.1, 104.94, 207.2

[56] References Cited

U.S. PATENT DOCUMENTS

| | | | |
|---|---|---|---|
| 2,216,333 | 10/1940 | White | 15/104.94 |
| 3,857,934 | 12/1974 | Bernstein | 424/409 |
| 5,061,106 | 10/1991 | Kent | 15/104.94 |
| 5,141,290 | 8/1992 | Mairon | 800/21 |
| 5,238,749 | 8/1993 | Cueman | 424/409 |
| 5,340,581 | 8/1994 | Tseng | 15/167.1 |
| 5,503,840 | 4/1996 | Jacobson | 424/405 |

FOREIGN PATENT DOCUMENTS

| | | | |
|---|---|---|---|
| 248726 | 3/1961 | Australia | 15/104.94 |
| 1236008 | 9/1989 | Japan | 15/167.1 |
| 6154030 | 6/1994 | Japan | 15/167.1 |

*Primary Examiner*—Randall E. Chin
*Attorney, Agent, or Firm*—Dougherty & Associates

[57] ABSTRACT

A brush having antimicrobial characteristics that inhibit bacterial growth. The antimicrobial agents, compounds or chemicals are embedded in either the body or bristles or both of the brush. Further, the present invention is a method of manufacturing a brush having antimicrobial characteristics that inhibit bacterial growth. An antimicrobial additive is incorporated in resin concentrate form into the amorphous zones of the molecular structure of the polymer from which brush handles are injection molded, thereby incorporating the antimicrobial agent into the brush handle. The antimicrobial additive in the body of the brush, incorporated in the manner above, results in substantive controlled migration from the body to the bristles, until a point of equilibrium is reached. The invention is suitable for any brush in which bristles are embedded in plastic, including toothbrushes, hair brushes, scrub brushes, toilet bowl brushes, cosmetic brushes, lip-color brushes, etc.

14 Claims, 2 Drawing Sheets

ANTIMICROBIAL BRUSH

CROSS REFERENCE TO RELATED APPLICATION

This application is a continuation-in-part of U.S. patent application Ser. No. 08/855,019 filed May 12, 1997, now abandoned.

FIELD OF THE INVENTION

This invention relates generally to antimicrobial brushes, and more particularly to brushes having antimicrobial compounds or chemicals embedded in either the handle or bristles or both, especially in a toothbrush.

BACKGROUND OF THE INVENTION

Elimination of tooth decay and/or periodontal disease caused by bacteria is important to dental hygiene. After a toothbrush has been used, a large number of bacteria cling to the bristles and onto the body of the toothbrush, even after the brush has been rinsed. Additionally, bacteria and fungi from other environmental sources within the bathroom can contaminate the toothbrush. These bacteria and fungi can grow and multiply on toothbrush bristles, handles, and the interface between the two while the toothbrush is being stored between uses. The bristles and the interface can be difficult to clean and over time significant levels of microbial contamination can build in this area.

Various means have been proposed for minimizing microbial contamination of toothbrushes. A self-sterilizing toothbrush is described in White et al., U.S. Pat. No. 2,216,333, and includes a combination of a water soluble salt (e.g., sodium carbonate) with an anti-microbial agent (e.g., sulfur). The two are fused to a solid hard body and attached to the head of the toothbrush at the base of the bristles. When exposed to water, the sodium carbonate dissolves, forming an alkaline solution that in turn dissolves some sulfur, which kills bacteria. Kent, U.S. Pat. No. 5,061,106, describes including capsules or microspheres in the tuft holes in which the bristles of a toothbrush are mounted. The capsules include a disinfectant or medicant that is released during use. Tseng et al., U.S. Pat. No. 5,340,581, describes a sustained-release matrix for dental application. The matrix includes an anti-microbial agent that is released over time when the matrix is exposed to water. The matrix may also include a colorant and a water-leachable substance to cause the matrix to change color corresponding with the depletion of the agent in the matrix.

Although several antimicrobial agents exist, the majority are not appropriate for contact with the delicate mucosal tissues of the mouth on a repeated basis. Furthermore, topical treatments of the fiber on plastic handles or bristles are not durable and are removed through the abrasive process of toothbrushing. What is needed is an antimicrobial agent which can be incorporated into the body, head or handle of the brush at the time of manufacture, which is free from toxic effect and is durable over the lifespan of the brush.

SUMMARY OF THE INVENTION

The present invention is a brush having antimicrobial characteristics that inhibit bacterial growth. The antimicrobial agents, compounds or chemicals are embedded in either the polymeric body or polymeric bristles or both of the brush. Further, the present invention is a method of manufacturing a brush having antimicrobial characteristics that inhibit bacterial growth. An antimicrobial additive is incorporated in resin concentrate form into the amorphous zones of the molecular structure of the polymer from which brush handles are injection molded, thereby incorporating the antimicrobial agent into the brush handle. The high levels of antimicrobial additive in the body of the brush, incorporated in the manner above, results in substantive controlled migration from the body into the polymeric bristles, until a point of equilibrium is reached. As the polymeric bristles are abraded during use and this equilibrium is disrupted, additional migration is stimulated, until equilibrium is again reached. The invention is suitable for any brush in which polymeric bristles are embedded or inserted in plastic, including, without limitation, toothbrushes, hair brushes, scrub brushes, toilet bowl brushes, cosmetic brushes, lip-color brushes, etc.

OBJECTS OF THE INVENTION

The principal object of the invention is to provide a brush having antimicrobial protection for the brush bristles, the interface between the brush handle and the bristles, and the handle itself, in a cost-effective, non-toxic, durable way.

Another object of the invention is to provide antimicrobial protection that allows for controlled migration of an antimicrobial agent throughout a polymer.

Another object of the invention is to provide a brush having an antimicrobial agent which is insoluble in water, thereby preventing any leaching of the agent during use of the brush.

Another object of the invention is to provide a brush in which an antimicrobial agent can migrate on demand from the body of the brush into the bristle as abrasion removes the agent from the bristle surface.

BRIEF DESCRIPTION OF THE DRAWINGS

These and other objects will become more fully understood by reference to the following detailed description of the invention and the appended drawing in which.

DETAILED DESCRIPTION OF THE INVENTION

Figure 1:
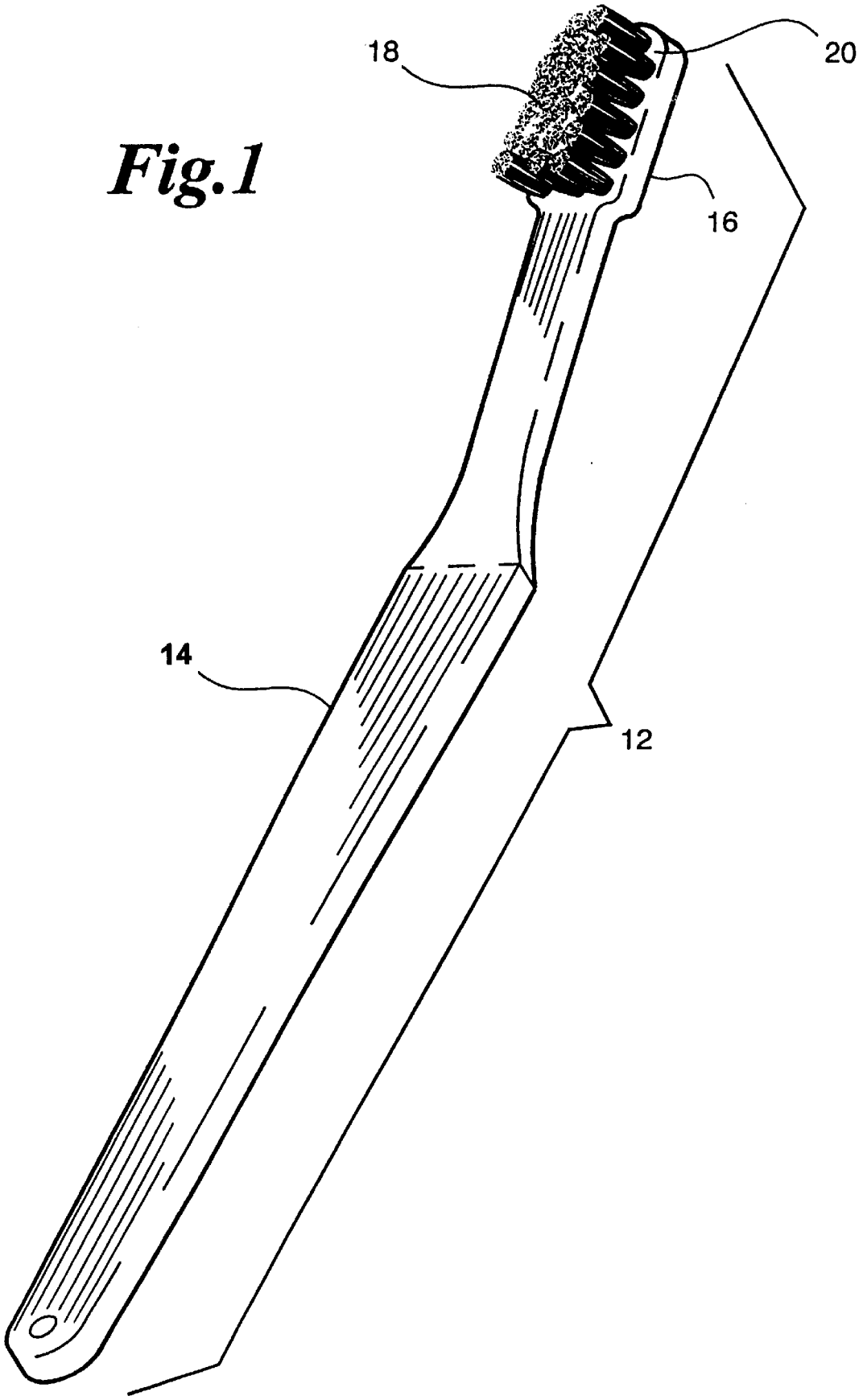
FIG. 1 is an isometric view of an antimicrobial toothbrush according to the present invention.

While the present invention is described as a toothbrush, the present invention is not intended to be limited to toothbrushes and may be applied to brushes having polymer bodies, handles or heads and nylon or other synthetic bristles attached to the brush body. Further, dyes and color may be incorporated into the polymer to produce toothbrushes and other brushes of varying colors.

In the most basic form of the present invention, the brush includes a broad spectrum antimicrobial agent associated therewith to inhibit bacterial, fungal, viral and other pathogen growth. The brush has a body with an elongate handle and a head, a plurality or ploymeric bristles attached to the head of the body, and an antimicrobial agent integrally associated with the brush. Preferably, an antimicrobial agent is associated or incorporated into the polymeric material from which the brush is made. Thus, an effective amount of an antimicrobial substance (e.g., 5-chloro-2-(2,4-dichlorophenoxy)phenol) is incorporated therein. Levels of active ingredients or antimicrobial substance range from 1000 to 5000 parts per million (ppm) by weight. These levels are substantially higher than would otherwise be required for antimicrobial efficacy in order to enhance migration from the brush body into nylon bristles.

The brush having the antimicrobial agent therein is further resistant to growth of fungus, yeast, virus, and gram positive and gram negative bacteria including *S. aureus, E. coli, K. pneumoniae*, and Salmonella. The antimicrobial substance, which is non-toxic and free of heavy metal, may be a chlorinated phenol (e.g., 5-chloro-2-(2,4-dichlorophenoxy) phenol). An alternative antimicrobial agent is polyhexamethylene biguanide hydrochloride (PHMB). Other chemical compounds having known antimicrobial characteristics may also be used in the present invention. The preferred method of associating the antimicrobial agent with the brush is to incorporate the antimicrobial agent into a synthetic, polymeric master batch prior to forming the brush body.

For example, 5-chloro-2-(2,4-dichlorophenoxy)phenol was incorporated in resin-concentrated form into the amorphous zones of the polymers from which toothbrush bodies were injection-molded. After molding, the handles were tested for antimicrobial efficacy using AATCC method 147, or Kirby-Bauer method in which, after a predetermined period of time, the zone of inhibition of the organism is measured in millimeters. The antimicrobial characteristics of the toothbrush handles were found to be very efficacious.

Polymeric materials used for the bristle compositions are preferably nylon, such as 6-nylon, 6,6-nylon, 6,10-nylon, 12-nylon and 4,6-nylon. More preferably, the bristle composition is 6,12-nylon. Nylon used to form the bristles is a difficult material to incorporate antimicrobial agents because of the high temperatures associated with producing and forming nylon and because of the crystalline structure of nylon. In a preferred embodiment of the present invention, antimicrobial agents are incorporated into the brush body to migrate into the bristles. The antimicrobial agent incorporated into the brush body is characterized in that the agent moves from areas of high concentrations of agent to low concentrations of agent. The antimicrobial additive chosen was essentially insoluble in water which prevented any leaching of the compound during use.

By controlling the amount of antimicrobial agent incorporated into the brush body, migration of antimicrobial agent from the brush body into the bristles is accomplished while maintaining the structural integrity of the brush body. Surprisingly, even when different polymeric materials are used for the bristles and brush body, the selected antimicrobial agent migrates across the interface between the brush body and the bristles into the bristles when incorporated using the method described herein. Incorporating an appropriate amount of antimicrobial agent into the brush body is important. High concentrations of antimicrobial agent incorporated into the brush body can result in degradation of the physical properties of the polymer composing the brush body. Low concentrations of antimicrobial agent incorporated into the brush body minimize the migration of antimicrobial agent into the bristles. The appropriate concentration range of antimicrobial agent in the brush body is necessary to effectively provide nontoxic, antimicrobial protection to the brush without sacrificing desirable physical properties of the polymer used to form the brush body.

The brush body can be made from polymers such as polypropylene, styrene, polystyrene, polyethylene, ultra high molecular weight polyethylene, acrylonitrile-butadiene-styrene (ABS), polyester, polyester elastomer, polyester urethane, ethylene/propylene alloy, silicone, polyvinyl chloride, chlorinated polyvinyl chloride, polyvinylidene fluoride, vinyl esters, cellulose acetate proprionate (CAP), polycarbonate, polyolefin alloy, thermoplastic and thermosetting plastic. The brush body is preferably made from polypropylene, styrene, ABS, PVC, CAP, polyethylene, Monoprene or Santoprene (a polyolefin alloy of Monsanto Chemical).

Incorporating antimicrobial agent into the polymer during manufacture of the polymer is difficult because of the high temperatures and varying physical parameters involved. Organic antimicrobial agents typically have a vaporization point less than the temperatures involved during manufacture of the polymer. For example, 5-chloro-2-(2,4-dichlorophenoxy)phenol has a range of liquid phase from about 135° F. to about 165° F. and a vaporization point of about 400° F., whereas the temperatures associated with forming plastic are typically above 400° F. In that respect, if antimicrobial agent is introduced into the polymer during manufacture, the agent typically vaporizes and does not become incorporated into the polymer. Alternatively, the antimicrobial agent may cross-link with the polymer. Cross-linking of the antimicrobial agent with the polymer is undesirable because the physical properties of the polymer can be degraded. Furthermore, cross-linking prevents the migration of antimicrobial agent through the polymer of the brush body and eventually into the bristles through the interface of the body with the bristles.

After the brush body is formed, the nylon bristles are attached to the brush body at the brush head. The nylon bristles are preferably left untreated prior to attachment to the brush head and are preferably attached to the brush head by insertion, a staking process using friction to hold bristles in place.

The preferred method of associating the antimicrobial agent with the brush body is to incorporate the agent into a synthetic polymeric master batch containing approximately 10% active ingredient prior to forming the brush body. In that respect, the antimicrobial agent in concentrate pellet form is added as a component to the mixture comprising the synthetic polymeric material in a let-down ratio which results in a final concentration of active ingredient of from about 0.005 percent to about 2.0 percent by weight. The active antimicrobial biocidal or biostatic agent preferably comprises from about 0.15 percent to about 0.25 percent by weight of the synthetic polymer into which the agent is incorporated. The resulting synthetic polymeric mixture is injection molded or formed by any other molding process (e.g., compression or extrusion) to provide the brush body.

Referring now to FIG. 1, an antimicrobial toothbrush in accordance with the present invention has a body 12 with an elongate handle 14 and a head 16, a plurality of polymeric bristles 18 attached to the head 16 of the toothbrush body 12, and an antimicrobial agent integrally associated with the toothbrush. The polymeric bristles 18 are attached to the head 16 at an interface 20 of the polymeric bristle 18 and the head 16. In a preferred embodiment of the present invention, an antimicrobial additive, 5-chloro-2-(2,4-dichlorophenoxy) phenol, is embedded into the toothbrush body 12 during manufacture of the body 12. When forming the toothbrush body 12, the process uses a synthetic master batch of polymer pellets. The antimicrobial agent to be introduced to the polymer is preferably encapsulated with polymer during master batch production. By encapsulating the antimicrobial agent with polymer, the active ingredient survives incorporation into the toothbrush body 12. The pellets created during the master batch production contain 10% of the active additive or antimicrobial agent. The encapsulated material is combined with the typical polymer pellets, and the resulting polymer is formed into a toothbrush body 12 using molding methods such as injection molding.

By combining pellets from the master batch production with other polymer pellets, the resulting polymer in the toothbrush body that is formed has a known concentration of antimicrobial agent. A range of from about 0.1% to about 0.5% of antimicrobial agent in the resulting polymer is preferred. The preferable range of antimicrobial agent incorporated into the polymer is from about 0.15% to 0.25%. Because of the encapsulation of the antimicrobial agent, the antimicrobial agent survives heating process and is incorporated into the amorphous zones of the polymer. The characteristics of the antimicrobial agent allow the agent to migrate through the polymer to the surface of the toothbrush body 12 from the amorphous zones until equilibrium of the agent's internal vapor pressure is reached. As the antimicrobial agent on the surface of the toothbrush is removed by friction, or other means more antimicrobial agent will move to the surface until the agent's internal vapor pressure is once again at equilibrium. Normally the antimicrobial agent melts at approximately 150° F., and loses its biocidal properties when heated above 400° F. However, in the present invention, by encapsulating the antimicrobial agent prior to combining or incorporating the agent into the toothbrush body 12, we have found that the antimicrobial agent loses none of its biocidal properties in the formed toothbrush body 12.

The nylon bristles 18 are preferably left untreated prior to insertion into sockets on the toothbrush head 16. After insertion, a staking process using friction to hold bristles 18 in place, the finished toothbrushes were again tested. This time the bristles 18 were removed and tested after 14 days. The bristles 18 were found to be significantly antimicrobial by providing zones of inhibition at the base, middle and top portions of the bristles 18 despite the division of the material types used for the handle 14 and the bristles 18. For example, using a polypropylene handle and nylon bristles 18, permanent migration of the antimicrobial agent into the molecular structure of the nylon bristles 18 had occurred. By producing the toothbrush body 12 using a molding method combined with high levels of antimicrobial additive in the toothbrush body 12, this unexpectedly resulted in substantive migration of antimicrobial agent from the toothbrush body 12, across the interface 20 of the bristles 18 and the head 16, and into the bristles 18. In addition, the antimicrobial characteristics were durable due to the reservoir of active ingredient present in the handle 14 which could migrate on demand to the bristles 18 as abrasion removes the antimicrobial agent from the bristles 18 surface.

The antimicrobial additive chosen was essentially insoluble in water which prevented any leaching of the compound during use. In use, the antimicrobial agent migrates through the polymer material to the exposed surface thereof from the amorphous zones of the polymer until equilibrium of the internal vapor pressure is reached. If the antimicrobial substance on the surface of the toothbrush or the bristles 18 is removed by friction, or other means, antimicrobial agent moves to the surface until the agent's internal vapor pressure is once again at equilibrium.

Tables 1–4b show the results of testing the materials of our toothbrush body and bristles under the conditions and by the tests specified. The AATCC results clearly indicate that the materials are well suited for antimicrobial toothbrush applications and that antimicrobial agent, 5-chloro-2-(2,4-dichlorophenoxy)phenol, survives incorporation into the materials of the toothbrush body. Further, the results show that the antimicrobial characteristics of our toothbrush body and bristles are very efficacious.

Interpretation of Results

NZ=No zone.

NI=No inhibition of growth under the sample.

I=Inhibition of growth under the sample.

mm=Zone of inhibition reported in millimeters.

TABLE 1

| Sample Identification | *Staphylococcus aureus* | *Klebsiella pneumoniae* |
|---|---|---|
| 5966-Tooth Brush Bristles | I/4 mm | I/6 mm |
| 5967-Tooth Brush Bristles | I/24 mm | I/32 mm |
| 5968-Tooth Brush Handle | I/22 mm | I/18 mm |

Table 1 shows the results of test method AATCC 147 for nylon toothbrush bristles and polypropylene toothbrush body. The samples were placed in nutrient broth containing test organisms, *Staphylococcus aureus* and *Klebsiella pneumoniae*, and incubated at 37° C. for 18 to 24 hours. Antimicrobial agent, 5-chloro-2-(2,4-dichlorophenoxy) phenol, was incorporated only into the body and then the bristles were inserted into the toothbrush head. The results show that the antimicrobial agent survived incorporation into the toothbrush body. Additionally, the results show migration of the antimicrobial agent from the polypropylene toothbrush handle into the nylon bristles despite the difference in materials.

TABLE 2

| Sample Identification | *Staphylococcus aureus* | *Klebsiella pneumoniae* |
|---|---|---|
| CAP Toothbrush handle Clear 1,500 ppm MB | I/5 mm | I/2 mm |
| Bristles Upper Portion | I/6 mm | I/4 mm |
| Bristles Lower Portion | I/7 mm | I/2 mm |
| Santoprene Green Handle 1,500 ppm MB | I/26 mm | I/17 mm |

Table 2 shows the results of test method AATCC 147 for toothbrush bodies formed of different polymers incorporating antimicrobial agent, 5-chloro-2-(2,4-dichlorophenoxy) phenol, therein and nylon bristles that were attached to the toothbrush head. The samples were placed in nutrient broth containing test organisms, *Staphylococcus aureus* and *Klebsiella pneumoniae*, and incubated at 37° C. for 18 to 24 hours. The bristles were segmented to demonstrate the varying concentrations of migrated antimicrobial agent throughout the bristles. The results show that the antimicrobial agent survived incorporation into toothbrush handles of different types of polymer (i.e., Santoprene and CAP). The results show that the incorporated antimicrobial agent migrated to and through the nylon bristles from various types of polymer handles (i.e., Santoprene and CAP) despite the difference in materials.

TABLE 3

| Sample Identification | *S. aureus* | *K. pneumoniae* |
|---|---|---|
| CAP Toothbrush Handle 1,500 ppm MB | I/4 mm | I/1 mm |
| CAP Toothbrush Handle 2,500 ppm MB | I/6 mm | I/5 mm |

Table 3 shows the results of test method AATCC 147 for toothbrush handles formed of CAP incorporating different concentrations of antimicrobial agent, 5-chloro-2-(2,4-dichlorophenoxy)phenol. The samples were placed in nutrient broth containing test organisms, *Staphylococcus aureus* and *Klebsiella pneumoniae*, and incubated at 37° C. for 18 to 24 hours. The results show that as the concentration of incorporated antimicrobial agent is increased in the handle, more bacteria growth is inhibited.

TABLE 4a

| | *Staphylococcus aureus* | | |
|---|---|---|---|
| Material | Handle | Lower Portion Nylon Bristles | Upper Portion Nylon Bristles |
| PP | I/9 mm | I/7 mm | I/5 mm |
| CAP | I/2 mm | I/2 mm | I/2 mm |

TABLE 4b

| | *Klebsiella pneumoniae* | | |
|---|---|---|---|
| Material | Handle | Lower Portion Nylon Bristles | Upper Portion Nylon Bristles |
| PP | I/6 mm | I/4 mm | I/2 mm |
| CAP | I/1 mm | I/1 mm | I/1 mm |

PP = Polypropylene
CAP = Cellulose Acetate Proprionate

Tables 4a and 4b show the antimicrobial properties of toothbrush bristles after insertion into a toothbrush body treated with 2,000 ppm of antimicrobial agent, 5-chloro-2-(2,4-dichlorophenoxy)phenol. A portion of the bristles were cut from the head of the toothbrush. This portion was then cut again to provide a lower portion and an upper portion. The lower and upper portions and a section of the handle were placed on inoculated petri dishes of *Staphylococcus aureus* (Table 4a) and *Klebsiella pneumoniae* (Table 4b), incubated for 24 hours, and observed for zones of inhibition around the samples. The results show that the incorporated antimicrobial agent migrates through handles made of polypropylene and CAP, and migrates to a greater degree in the polypropylene handles. Additionally, the results show that the incorporated antimicrobial agent migrates to a greater degree into and through the nylon bristles from the polypropylene handle than from the CAP handle.

ALTERNATIVE EMBODIMENTS

While the present invention particularly relates to toothbrushes having polymer bodies, handles or heads, and nylon or other synthetic bristles embedded in the toothbrush body, it is possible to incorporate an antimicrobial agent into the polymer bodies of many types of brushes having nylon or other synthetic bristles embedded in the brush body.

Figure 2:
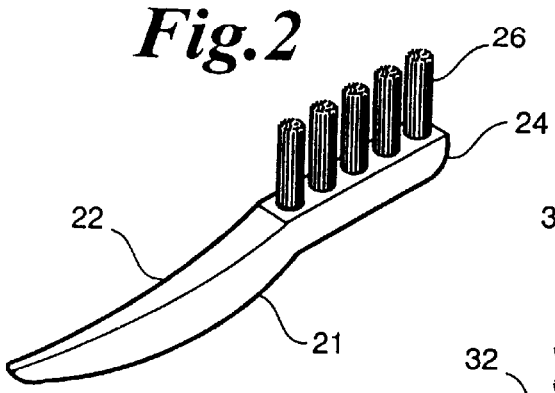
FIG. 2 is an isometric view of an antimicrobial cosmetic brush according to the present invention.

In an alternative embodiment of the present invention, FIG. 2 is an antimicrobial cosmetic brush according to the present invention. Cosmetic brushes are generally used to apply make-up or cosmetics to a person's face. The cosmetic brush has a body 21 with an elongate handle 22 and a head 24, a plurality of polymeric bristles 26 attached to the head 24, and an antimicrobial agent integrally associated with the cosmetic brush. By incorporating an antimicrobial agent into the polymer body 21 of the cosmetic brush, infectious agents such as bacteria, germs or other pathogens contacting the cosmetic brush can be inactivated.

Figure 3:
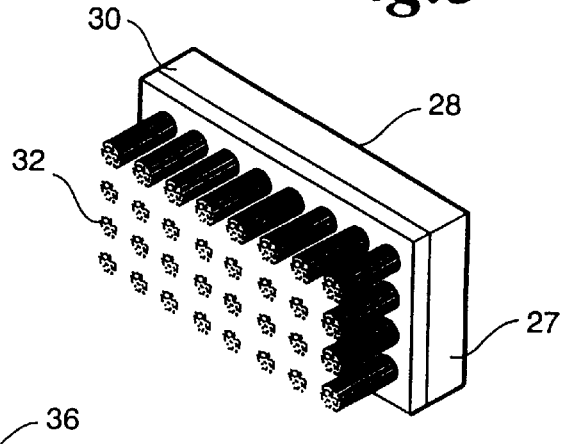
FIG. 3 is an isometric view of an antimicrobial scrub brush according to the present invention.

In another alternative embodiment of the present invention, FIG. 3 is an antimicrobial scrub brush according to the present invention. Scrub brushes are generally used to abrade tissue surfaces, such as skin, in order to break-up and remove contaminants. The scrub brush has a body 27 with an elongate handle 28 and a head 30, a plurality of polymeric bristles 32 attached to the head 30, and an antimicrobial agent integrally associated with the scrub brush. By incorporating an antimicrobial agent into the polymer body 27 of the scrub brush, contaminants, such as germs and bacteria, that remain on the scrub brush are inactivated.

Figure 4:
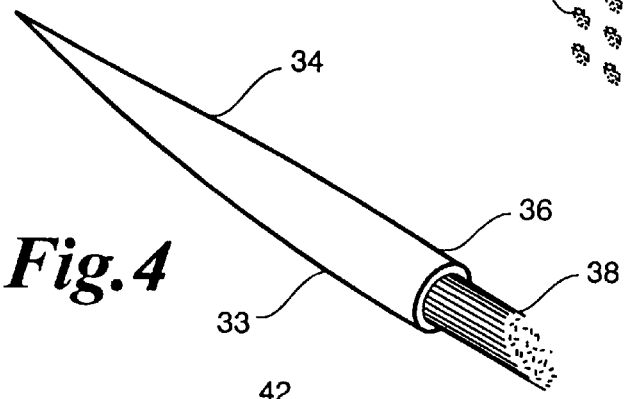
FIG. 4 is an isometric view of an antimicrobial lip-color brush according to the present invention.

In another alternative embodiment of the present invention, FIG. 4 is an antimicrobial lip-color brush according to the present invention. Lip-color brushes are generally used to apply lip-color or lip-stick to a person's lips. The lip-color brush has a body 33 with an elongate handle 34 and a head 36, a plurality of polymeric bristles 38 attached to the head 36, and an antimicrobial agent integrally associated with the lip-color brush. By incorporating an antimicrobial agent into the polymer body 33 of the lip-color brush, infection-causing agents, such as bacteria and viruses, remaining on the lip-color brush are inactivated.

Figure 5:
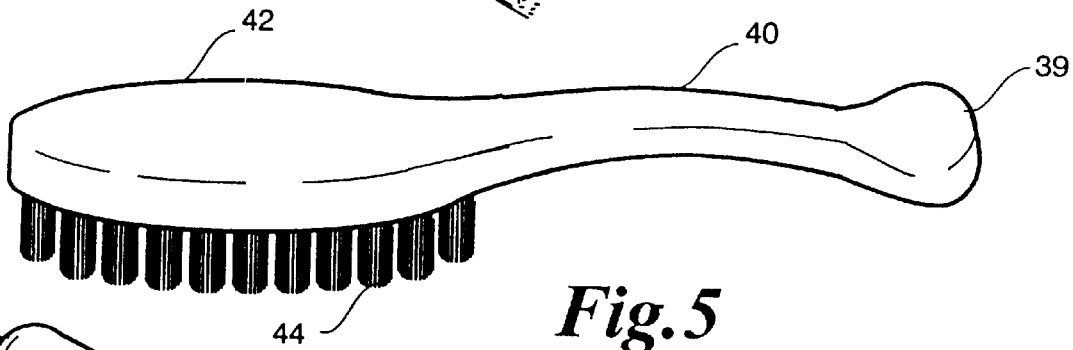
FIG. 5 is an isometric view of an antimicrobial hair brush according to the present invention.

In another alternative embodiment of the present invention, FIG. 5 is an antimicrobial hair brush according to the present invention. Hair brushes are generally used for hair care, such as detangling hair and removing dead hair follicles. The hair brush has a body 39 with an elongate handle 40 and a head 42, a plurality of polymeric bristles 44 attached to the head 42, and an antimicrobial agent integrally associated with the hair brush. By incorporating an antimicrobial agent into the polymer body of the hair brush, bacteria, germs and viruses remaining on the hair brush are inactivated.

Figure 6:
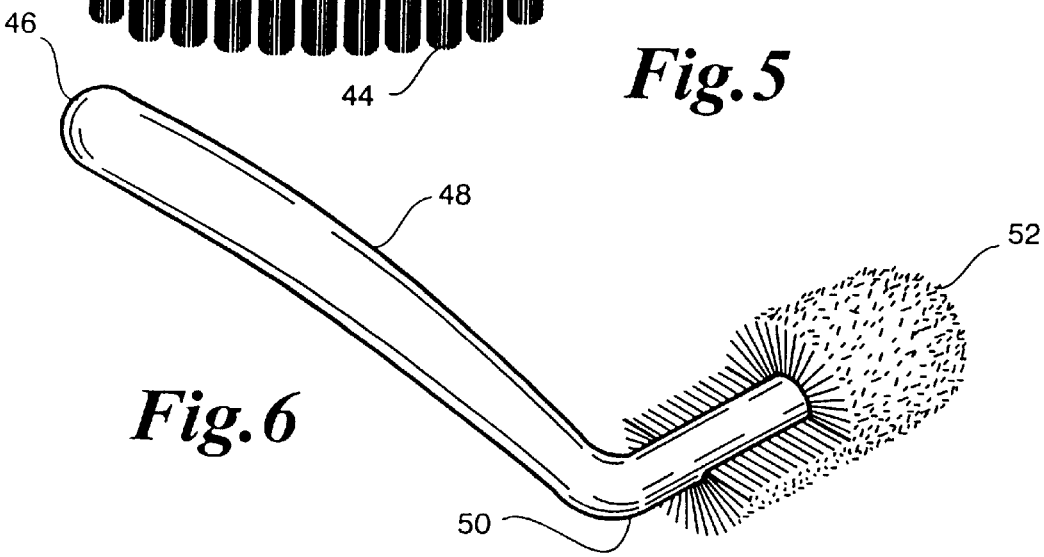
FIG. 6 is an isometric view of an antimicrobial toilet-bowl brush according to the present invention.

In another alternative embodiment of the present invention, FIG. 6 is an antimicrobial toilet bowl brush according to the present invention. Toilet bowl brushes are generally used to remove waste and cleanse toilet bowls. The toilet bowl brush has a body 46 with an elongate handle 48 and a head 50, a plurality of polymeric bristles 52 attached to the head 50, and an antimicrobial agent integrally associated with the toilet bowl brush. By incorporating an antimicrobial agent into the polymer body of the toilet bowl brush, waste remaining on the toilet bowl brush are decontaminated.

SUMMARY OF THE ACHIEVEMENTS OF THE OBJECTS OF THE INVENTION

It is readily apparent that we have invented a brush having antimicrobial protection for the brush bristles, the interface between the brush handle and the bristles, and the handle itself, in a cost-effective, non-toxic, durable way. The present invention also provides anti-microbial protection that allows for controlled migration of an anti-microbial agent throughout a polymer. The present invention also provides a brush having an antimicrobial agent which is insoluble in water, thereby preventing any leaching of the agent during use of the brush. The present invention also provides a brush in which an antimicrobial agent can migrate on demand from the body of the brush to the bristle as abrasion removes the agent from the bristle surface.

It is to be understood that the foregoing description and specific embodiments are merely illustrative of the best mode of the invention and the principles thereof, and that various modifications and additions may be made to the apparatus by those skilled in the art, without departing from the spirit and scope of this invention, which is therefore understood to be limited only by the scope of the appended claims.

What is claimed is:

1. A brush having antimicrobial characteristics which comprises:

a body having a polymeric handle and a polymeric head, said polymeric handle and said polymeric head being composed of a polymeric material having a plurality of amorphous zones;

a plurality of polymeric bristles embedded in said polymeric head of said body, said polymeric bristles being composed of a polymeric material;

an interface between said body and said plurality of polymeric bristles; and a non-leaching antimicrobial agent associated with said body wherein said antimicrobial agent is incorporated into said amorphous zones of said polymeric material of said body, and wherein said antimicrobial agent exhibits controlled migration through said amorphous zones of said polymeric material of said body, across said interface between said body and said polymeric bristles, and into and through said polymeric material of each of said polymeric bristles.

2. A brush according to claim 1 wherein said antimicrobial agent exhibits controlled migration through said amorphous zones of said polymeric material of said body, across said interface between said body and said polymeric bristles, and into and through said polymeric material of each of said polymeric bristles, when an imbalance of vapor pressure of said antimicrobial agent demands equalization.

3. A brush according to claim 1 wherein said antimicrobial agent is a chlorinated phenol.

4. A brush according to claim 1 wherein said antimicrobial agent is selected from the group consisting of 5-chloro-2-(2,4-dichlorophenoxy)phenol and polyhexamethylene biguanide hydrochloride.

5. A brush according to claim 1 wherein said antimicrobial agent is present in said polymeric material of said body in an amount of from about 0.005 percent to about 2.0 percent by weight.

6. A brush according to claim 1 wherein said antimicrobial agent is present in said polymeric material of said body in an amount of from about 0.15 percent to about 0.25 percent by weight.

7. A brush according to claim 1 wherein said polymeric material of said body is selected from the group consisting of polypropylene, styrene, polystyrene, polyethylene, ultra high molecular weight polyethylene, acrylonitrile-butadiene-styrene, polyester, polyester elastomer, polyester urethane, ethylene/propylene alloy, silicone, polyvinyl chloride, chlorinated polyvinyl chloride, polyvinylidene fluoride, vinyl esters, cellulose acetate proprionate, polycarbonate, polyolefin alloy, thermoplastic and thermosetting plastic.

8. A brush for promoting oral hygiene having antimicrobial characteristics which comprises:

a body having a polymeric handle and a polymeric head, said polymeric handle and said polymeric head being composed of a polymeric material having a plurality of amorphous zones;

a plurality of polymeric bristles embedded in said polymeric head of said body, said polymeric bristles being composed of a polymeric material;

an interface between said body and said plurality of polymeric bristles; and a non-leaching antimicrobial agent associated with said body wherein said antimicrobial agent is incorporated into said amorphous zones of said polymeric material of said body, and wherein said antimicrobial agent exhibits controlled migration through said amorphous zones of said polymeric material of said body, across said interface between said body and said polymeric bristles, and into and through said polymeric material of each of said polymeric bristles.

9. A brush according to claim 8 wherein said antimicrobial agent exhibits controlled migration through said amorphous zones of said polymeric material of said body, across said interface between said body and said polymeric bristles, and into and through said polymeric material of each of said polymeric bristles, when an imbalance of vapor pressure of said antimicrobial agent demands equalization.

10. A brush according to claim 8 wherein said antimicrobial agent is a chlorinated phenol.

11. A brush according to claim 8 wherein said antimicrobial agent is selected from the group consisting of 5-chloro-2-(2,4-dichlorophenoxy)phenol and polyhexamethylene biguanide hydrochloride.

12. A brush according to claim 8 wherein said antimicrobial agent is present in said polymeric material of said body in an amount of from about 0.005 percent to about 2.0 percent by weight.

13. A brush according to claim 8 wherein said antimicrobial agent is present in said polymeric material of said body in an amount of from about 0.15 percent to about 0.25 percent by weight.

14. A brush according to claim 8 wherein said polymeric material of said body is selected from the group consisting of polypropylene, styrene, polyvinyl chloride, cellulose acetate propionate, polyethylene, acrylonitrile-butadiene-styrene, polyolefin alloy.

* * * * *